US006662700B2

(12) United States Patent
O'Neill

(10) Patent No.: US 6,662,700 B2
(45) Date of Patent: Dec. 16, 2003

(54) METHOD FOR PROTECTING AN AIRCRAFT AGAINST A THREAT THAT UTILIZES AN INFRARED SENSOR

(75) Inventor: Mary Dominique O'Neill, Santa Barbara, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/139,005

(22) Filed: May 3, 2002

(65) Prior Publication Data

US 2003/0205126 A1 Nov. 6, 2003

(51) Int. Cl.[7] ..... F42B 12/70; F41J 2/02

(52) U.S. Cl. ..... 89/1.11; 102/345; 102/505; 244/136; 244/1 TD

(58) Field of Search ..... 89/1.11; 102/345, 102/336, 505; 244/136, 1 TD, 137.4

(56) References Cited

U.S. PATENT DOCUMENTS 3,150,848 A 9/1964 Lager
4,183,302 A * 1/1980 Schillreff ..... 102/377
4,498,392 A * 2/1985 Billard et al. ..... 102/342
4,621,579 A * 11/1986 Badura et al. ..... 102/334
5,381,721 A * 1/1995 Holmstrom et al. ..... 89/1.51
5,411,225 A * 5/1995 Lannon et al. ..... 244/137.1
5,773,745 A * 6/1998 Widmer ..... 89/1.11
5,915,694 A * 6/1999 Brum ..... 273/359
6,055,909 A 5/2000 Sweeny
6,352,031 B1 * 3/2002 Barbaccia ..... 102/365

FOREIGN PATENT DOCUMENTS

JP 2001356000 A * 6/2000 ..... F41H/11/02

* cited by examiner

*Primary Examiner*—Peter M. Poon
*Assistant Examiner*—John W. Zerr
(74) *Attorney, Agent, or Firm*—William C. Schubert; Glenn H. Lenzen, Jr.

(57) ABSTRACT

A method for protecting an aircraft against a threat that utilizes an infrared sensor includes providing a plurality of dispensable infrared sources transported in an infrared-source dispenser with the aircraft. A set of infrared-emitting properties of the infrared sources is selected responsive to a set of infrared detecting characteristics of the infrared sensor. A modulated pattern of the infrared sources is dispensed from the infrared-source dispenser responsive to at least one of the set of infrared detecting characteristics of the infrared sensor, and a geometric engagement scenario of the aircraft and the threat.

27 Claims, 4 Drawing Sheets

METHOD FOR PROTECTING AN AIRCRAFT AGAINST A THREAT THAT UTILIZES AN INFRARED SENSOR

BACKGROUND OF THE INVENTION

This invention relates to an approach to protect aircraft against threats that use infrared sensors.

Threats against military aircraft, such as air-launched or ground-launched missiles, are typically guided by a radar sensor, an infrared sensor, or both. Radar sensors are highly accurate in identifying and locating their targets. They have the disadvantage that they are active devices that emit radar signals, and their emissions may be detected by the target and used to evade or to launch a counter-attack against the radar source.

Infrared sensors, on the other hand, are passive devices that do not reveal their presence or operation. The great majority of aircraft losses to hostile attacks over the past 20 years have been to infrared-guided missiles. In most cases, the pilots of the aircraft that were shot down were not aware that they were under attack until the infrared-guided missile detonated.

Infrared-guided missiles have the disadvantage that they typically must be initially positioned much more closely to their potential targets in order for the infrared sensor of the missile to be effective, as compared with a radar-guided missile. The fields of view of the infrared sensors are usually quite narrow, on the order of a few degrees. In most cases, the infrared sensor must therefore acquire its potential target prior to launch of the missile and remain "locked onto" the target for the entire time from launch until intercept. If the acquisition is lost during the flight of the missile, it is usually impossible to re-acquire the target without using an active sensor that warns the target of its presence.

There are a number of countermeasures to defeat infrared-guided missiles. Historically, the most common countermeasure has been the use of flares that produce false signals to confuse the infrared sensor. The current generation of infrared-guided missiles utilize counter-countermeasures programmed to ignore flares, based upon distinguishing features of the flares such as their different motion than the previously acquired target and/or their different heat-emitting properties as compared with the previously acquired target. Lamps and directional lasers may be used to blind or confuse the infrared sensor, but these approaches have drawbacks in respect to size, weight, complexity, and power requirements.

An important advance in infrared countermeasures to protect aircraft is described in U.S. Pat. No. 6,055,909. In the approach of the '909 patent, discrete packets of pyrophoric or other infrared-emitting material are dispensed in a controlled manner, and ignite to produce an infrared signal. The packets may be dispensed individually or in groups, so that various decoying strategies may be employed.

The approach of the '909 patent provides a dispensing apparatus and a dispensing strategy that are highly effective in dealing with a number of potential threats. However, there are other situations where there is a need to further improve the effectiveness of the infrared countermeasure. The present invention fulfills this need, and further provides related advantages.

SUMMARY OF THE INVENTION

The present invention provides a method for protecting an aircraft against a threat, such as a missile, that utilizes an infrared sensor. The present approach may be utilized with a towed infrared-source dispenser, or it may be used in other situations such as a dispenser built into the aircraft body, an externally mounted pod on the aircraft, or other types of dispensers. The present approach tailors the nature of the dispensed infrared sources and/or the modulated pattern of the dispensing so as to be highly effective against various types of infrared sensors and geometric engagement scenarios that may be encountered by the aircraft.

In accordance with the invention, a method for protecting an aircraft having an aircraft motion against a threat that utilizes an infrared sensor comprises the steps of providing a plurality of dispensable infrared sources in an infrared-source dispenser transported with the aircraft, wherein a set of infrared-emitting properties of the infrared sources is selected responsive to a set of infrared detecting characteristics of the infrared sensor. A modulated pattern of the infrared sources is dispensed from the infrared-source dispenser.

Typically, a rise time, a time-at-peak, and/or a burn duration of the infrared sources is selected responsive to the set of infrared detecting characteristics of the infrared sensor. The set of infrared-emitting properties may additionally be selected responsive to a set of operating characteristics of the missile and/or a set of operating characteristics of the aircraft. Thus, for example, the set of infrared-emitting properties of the infrared sources may be selected responsive to operating characteristics of the missile such as its infrared field of view of the infrared sensor or a counter-countermeasure triggering level of the infrared sensor. The set of infrared-emitting properties may for example be selected responsive to the infrared-signature characteristics of the aircraft.

In another form, a method for protecting an aircraft having an aircraft motion against a threat that utilizes an infrared sensor comprises the steps of providing a plurality of dispensable infrared sources transported in an infrared-source dispenser with the aircraft, and dispensing a modulated pattern of the infrared sources from the infrared-source dispenser. The pattern is determined responsive to a geometric engagement scenario of the aircraft and the threat and, optionally but preferably, the set of infrared detecting characteristics of the infrared sensor. The infrared performance of the dispensable infrared sources may be tailored as described previously.

The step of dispensing the modulated pattern desirably includes the substep of dispensing a first group of infrared sources including an initial-distraction subpattern having an infrared characteristic selected responsive to a set of infrared detecting characteristics of the infrared sensor, and desirably also an attention-holding subpattern tailored to the geometry of the engagement and, optionally but desirably, to the characteristics of the infrared sensor. An example of an attention-holding subpattern is a kinematic subpattern kinematically approximating the aircraft motion for a first geometric engagement scenario. The step of dispensing may further include the step of thereafter dispensing a second group of infrared sources including a second initial-distraction subpattern and a second attention-holding subpattern tailored to the characteristics of either a different engagement scenario of the same infrared sensor, or to a different infrared sensor. Typically, there is a gap between the first group of infrared sources and the second group of infrared sources.

Thus, a preferred method for protecting an aircraft having an aircraft motion against a threat that utilizes an infrared sensor comprises the steps of providing a plurality of dispensable infrared sources transported with the aircraft, wherein a set of infrared-emitting properties of the infrared sources is selected responsive to a set of infrared detecting characteristics of the infrared sensor, and dispensing a modulated pattern of the infrared sources from the aircraft determined responsive to the infrared detecting characteristics of the infrared sensor and/or a geometric engagement scenario of the aircraft and the threat.

The present approach goes beyond the approach of the '909 patent by utilizing specific information about the nature of the threat, the nature of the protected aircraft, and the geometric engagement scenario to improve the protection of the aircraft. In many instances, intelligence information about the nature of the threat is available before the aircraft is exposed to the threat. At least some information about the type or types of missiles, the infrared sensors, and the attack strategy that are available to and used by an enemy is often known. The deployment strategies for the infrared sources discussed in the '909 patent make use of this information in limited ways, and the present invention extends this use to the design and selection of the infrared sources themselves and the techniques for dispensing the modulated pattern of the infrared sources.

The nature of an attack by an infrared-guided missile is highly uncertain, posing a difficult protection problem for several reasons. First, the fact of an attack may not be known, because, unlike a radar-guided missile, the infrared detector emits no signal that the aircraft may detect. Second, the exact type of attacking missile may not be known with certainty. There is usually some information that an attacker will be using one or more of an inventory of several types of missiles whose characteristics vary, but exactly which one of the missiles is used in a particular attack is often not known. Third, the geometry of the engagement of the missile relative to the aircraft is not known. That is, it is not known for certain from where the missile will come relative to the flight direction of the aircraft, from where it is launched, its speed, and the like. These uncertainties are compounded by the fact that the infrared sensors of the missiles have built-in counter-countermeasures designed to defeat the countermeasures used by the aircraft.

The '909 patent discusses some possible protection scenarios based upon the dispensing of large numbers of pyrophoric foils in controlled patterns, but does not address the issue of optimizing the nature of the pyrophoric material. The present approach utilizes the foil dispenser described in the '909 patent or a similar type of approach, but goes further to define the nature of the pyrophoric foils that are most effective in distracting various types of infrared sensor. The present approach also goes beyond the approach of the '909 patent to define the modulated dispensing pattern to effectively respond to a variety of threats under the highly uncertain attack conditions described in the prior paragraph. An important consideration in the modulation and dispensing analysis is the most efficient use of the pyrophoric material, so that it may be dispensed over extended periods of time in a preemptive manner.

The present approach is based upon the concept that, assuming the worst case that the sensor of the missile has already acquired the aircraft signature, it is necessary first to initially distract the sensor from the aircraft to the dispensed infrared sources, and then to hold the attention of the sensor on the infrared sources for a sufficient period of time that the sensor does not re-acquire the aircraft signature. The infrared sources fall further and further behind the aircraft as the aircraft flies away from its dispensed pattern or the dispensed pattern falls away from the aircraft. As a result, even if the counter-countermeasures capability of the missile later determines that it is pursuing a signal that is not the aircraft, it will not be possible for the sensor to re-acquire the aircraft due to the limited field of view of the missile and the movement of the aircraft.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
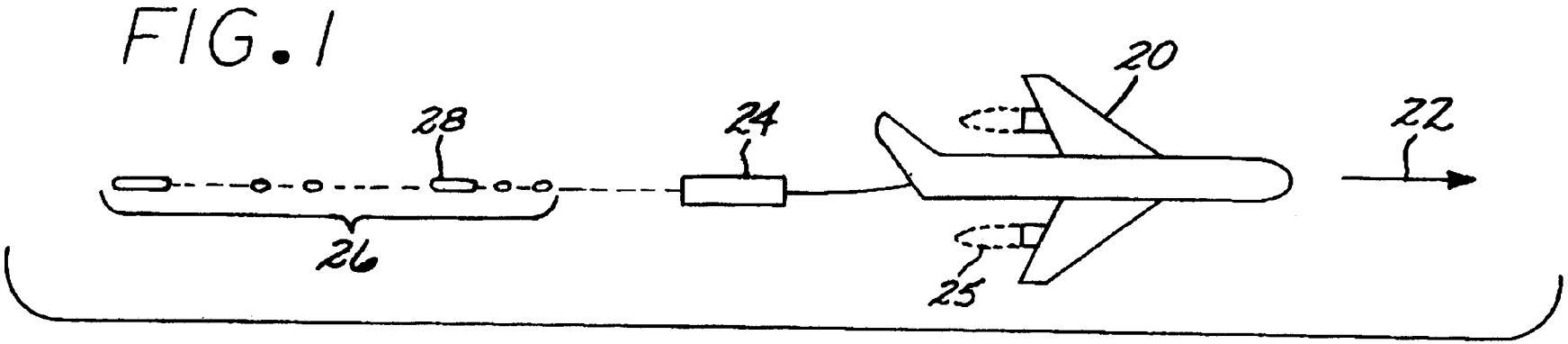
FIG. 1 is a schematic view of an aircraft towing an infrared-source dispenser that dispenses a pattern of infrared sources.
Figure 2:
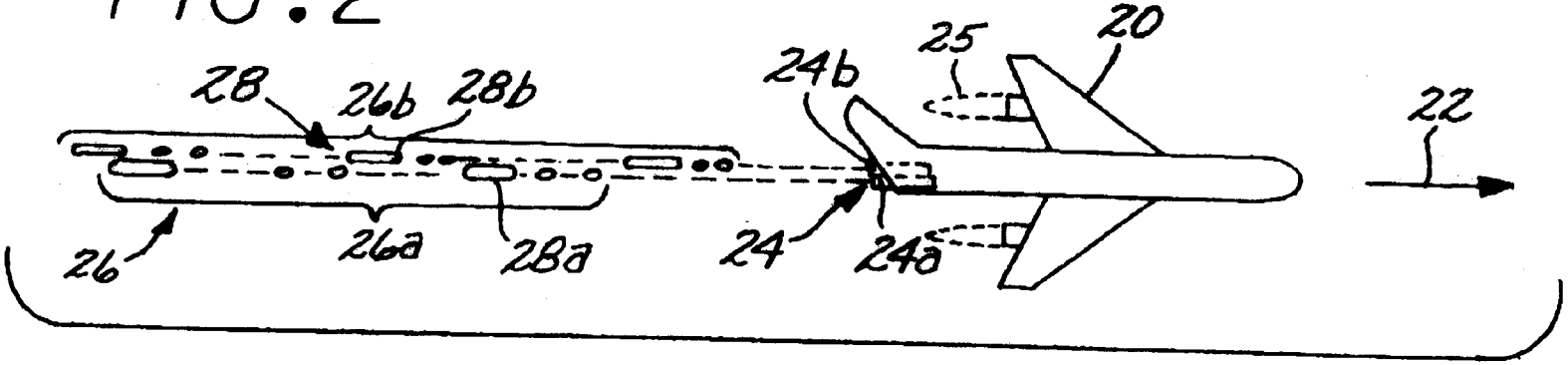
FIG. 2 is a schematic view of an aircraft emitting a pattern of infrared sources from an on-board dispenser.

FIG. 1 schematically illustrates an aircraft 20 flying in a direction of flight 22 and towing an infrared-source dispenser 24. The aircraft has an aircraft infrared-signature plume 25 emitted from its engines. The infrared-source dispenser 24 controllably dispenses a modulated pattern 26 of infrared sources 28. FIG. 2 is similar, but in FIG. 2 the infrared-source dispenser 24 is located on-board the aircraft 20, either internally within the aircraft or as an externally carried pod. In either case, the infrared-source dispensers 24 and the infrared sources 28 are "transported with the aircraft", until the infrared sources 28 are dispensed. The infrared-source dispensers 24 are controlled by electrical signals from the aircraft 20, by control signals generated internally or locally, or by a combination of such signals. The aircraft 20 may transport one or more of the infrared-source dispensers 24. In the case of more than one infrared-source dispenser 24, the infrared-source dispensers 24 may carry the same type of infrared sources 28, or different types of infrared sources. The infrared-source dispenser 24 and the infrared sources 28 are preferably of the type disclosed in U.S. Pat. No. 6,055,909, whose entire disclosure is incorporated by reference herein.

In FIG. 2 there is more than one infrared-source dispenser 24 available and operating. Specifically, in FIG. 2 there are two infrared-source dispensers 24*a* and 24*b*, dispensing two different patterns 26*a* and 26*b* of two respective infrared sources 28*a* and 28*b*. FIG. 2 illustrates the two dispensers 24*a* and 24*b* mounted together in the tail of the aircraft 20, but they may instead be mounted at different parts of the aircraft or towed behind the aircraft, such as one in the tail and one in an underwing pod, one in each of two underwing pods on either side of the aircraft, one in the tail and one in the fuselage further forward, one in a towed decoy and one in the aircraft, or any other combination. Mounting the dispensers 24*a* and 24*b* at longitudinally or laterally spaced locations provides additional positional variables that may be controlled in dispensing the modulated infrared source patterns.

The first dispenser 24*a* dispenses the first infrared source 28*a* having a first set of emitting properties, and the second dispenser 24*b* dispenses the second infrared source 28*b* having a second set of emitting properties. The infrared sources 28*a* and 28*b* may be of the same type or of different types. In FIG. 2, the two patterns 26*a* and 26*b* are being dispensed simultaneously so that both patterns are viewed by the sensor 36 at any moment in time. However, they may be dispensed sequentially. As will be discussed subsequently, the present approach provides that the nature of the infrared sources 28 may be selected responsive to the nature of the threat, the nature of the aircraft, the geometry of the engagement, and other factors. Thus, providing the infrared sources 28*a* and 28*b* of two different types allows more effective countermeasure modulation procedures to be employed. The ability to dispense two (or more) types of infrared sources 28 provides a capability that is not simply a duplication or multiplication of the capabilities in dispensing a single infrared source. As will be discussed more fully herein, the infrared sources 28 are selected according to the infrared detecting characteristics of the sensor 36 and other factors. The ability to dispense two different infrared sources 28 simultaneously, in a selectable pattern, increases the likelihood of success in decoying the threat 30. In yet another alternative, two types of infrared sources 28*a* and 28*b* may be loaded into a single infrared-source dispenser 24 and dispensed sequentially. The various features illustrated in FIGS. 1 and 2 and discussed herein may be used with each other to the extent that they are compatible.

Figure 3:
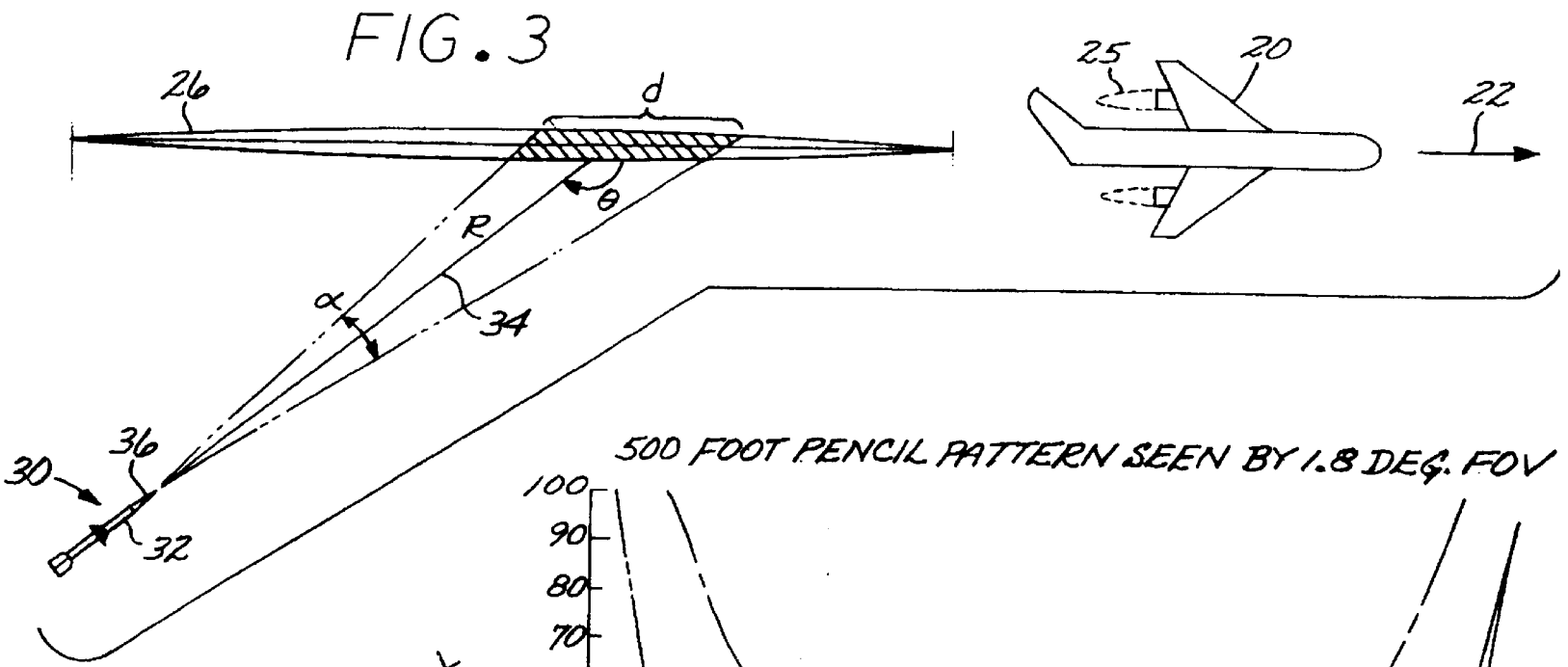
FIG. 3 is a schematic diagram of a geometric engagement scenario.

FIG. 3 depicts a threat 30 to the aircraft 20, here in the form of a missile 32 flying along a course along a threat flight vector 34 generally toward the vicinity of the aircraft 20, but in fact displaced slightly from the actual aircraft 20 due to the protection approach discussed herein. The threat 30 has a non-imaging infrared sensor 36, typically in its nose, with a field of view a. In current missile systems, the field of view $\alpha$ is quite narrow and is typically less than 3 degrees, and usually in the range of about 1–2 degrees. To protect the aircraft 20 from the threat 30, the threat 30 must be misdirected away from the aircraft 20 and toward the pattern 26 of infrared sources 28, here illustrated in a general form as a "pencil" pattern 26 extending behind the aircraft 20.

The geometry of the engagement of the aircraft 20 and the threat 30 may be characterized by an aspect angle $\theta$ between the direction of flight 22 of the aircraft 20 and the threat flight vector 34 of the threat 30. The threat 30 is at a distance R from the pattern 26, measured along the threat flight vector 34. The length lying along the direction of flight 22 that is within the field of view of the sensor 36, d, is approximately $$d=2R\tan(\alpha/2)/\sin\theta.$$

Figure 4:
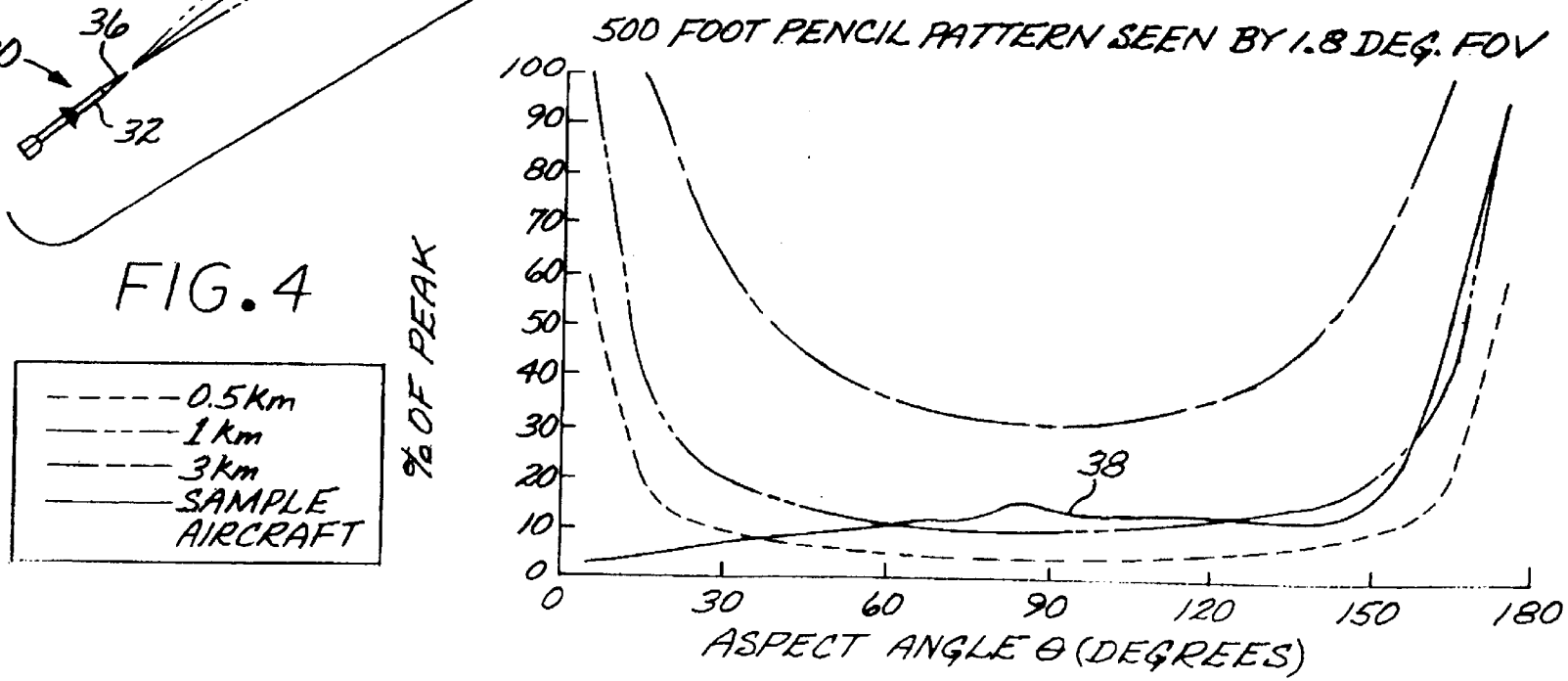
FIG. 4 is a graph of the view of the pattern of infrared sources as a function of the aspect angle 0 in the geometric engagement scenario of FIG. 3, for various distances of the missile from the pattern of infrared sources.

FIG. 4 is a graph illustrating the percentage of the entire length of the pattern 26, $d_{total}$, that is within the field of view of the sensor 36, as a function of the angle $\theta$ and for three different values of the range R of the threat 30 from the aircraft 20, during the engagement illustrated in FIG. 3. This engagement scenario assumes that the sensor 36 is tracking the aircraft 20 such that only one-half of the field of view of the sensor is available for sensing the pattern 26. In this calculation, the field of view $\alpha$ of the sensor 36 is taken to be 1.8 degrees, and the length of the pattern 26 $d_{total}$ is taken to be 500 feet. A value of $\theta$ of 0 degrees is a head-on aspect, a value of $\theta$ of 90 degrees is a side view of the aircraft, and a value of $\theta$ of 180 degrees is from behind the aircraft. Also shown is an exemplary but realistic aircraft-engine signature plume 38 as a function of the same angle $\theta$.

From FIGS. 3–4 it may be seen that the geometry of the engagement strongly influences the infrared energy sensed by the sensor 36. For small values of R, the sensor's view of the pattern 26 is similar to that of its view of the aircraft plume 38, for aspect angles $\theta$ greater than about 45 degrees. A uniformly dispensed pattern 26 of infrared sources 28 is sufficient for these cases, once the attention of the sensor 36 is drawn away from the aircraft plume 38 and toward the pattern 26. However, for smaller aspect angles $\theta$ and greater distances R (such as the illustrated 3 kilometers), the sensor's view of the pattern 26 is greatly different than its view of the aircraft plume 38. Sophisticated counter-countermeasures of the threat 30 may distinguish the uniform pattern 26 from the aircraft-engine signature plume 38, so that the dispensed pattern 26 is unsuccessful in diverting the threat 30 away from the aircraft 30.

Figure 5:
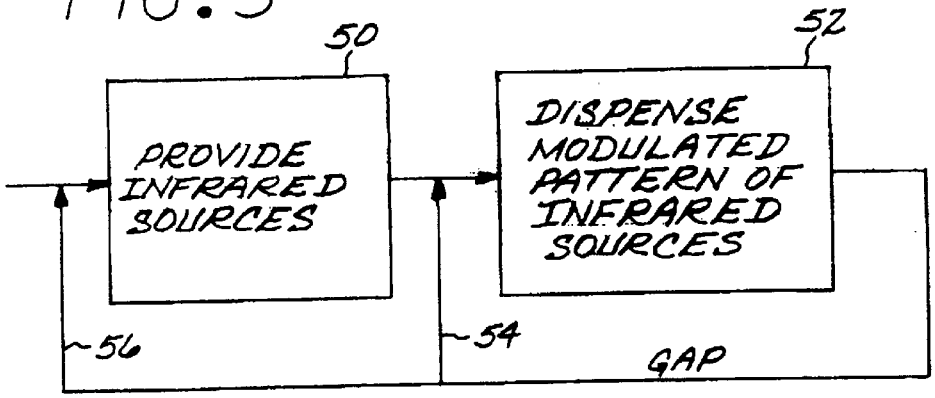
FIG. 5 is a block flow diagram of an approach for practicing the invention.

According to the present approach, either or both of the nature of the infrared sources 28 and the modulation of the pattern 26 may be varied. FIG. 5 depicts the general approach. A plurality of dispensable infrared sources 28 transported in the infrared-source dispenser 24 with the aircraft 20 is provided, step 50. A set of infrared-emitting properties of these infrared sources 26 is selected responsive to a set of infrared detecting characteristics of the infrared sensor 36. Thereafter, the modulated pattern 26 of the infrared sources 28 is dispensed from the infrared-source dispenser 24. The pattern 26 is determined responsive to the geometric engagement scenario of the aircraft 20 and the threat 30 and, optionally, also responsive to the set of infrared detecting characteristics of the infrared sensor 36. Step 52 may be and usually is repeated, step 54, with a gap in time and space between two sequential dispensing steps 52. Steps 50 and 52 may be repeated, step 56, selecting a different infrared source 28 if more than one type of infrared source 28 is available, as for example when there are two or more of the infrared-source dispensers 24 loaded with different types of the infrared sources 28.

The following discussion sets forth a presently preferred approach to determining the parameters associated with steps 50 and 52. As the approaches are more fully developed and experience is gained, it is expected that these techniques may be refined.

Figure 6:
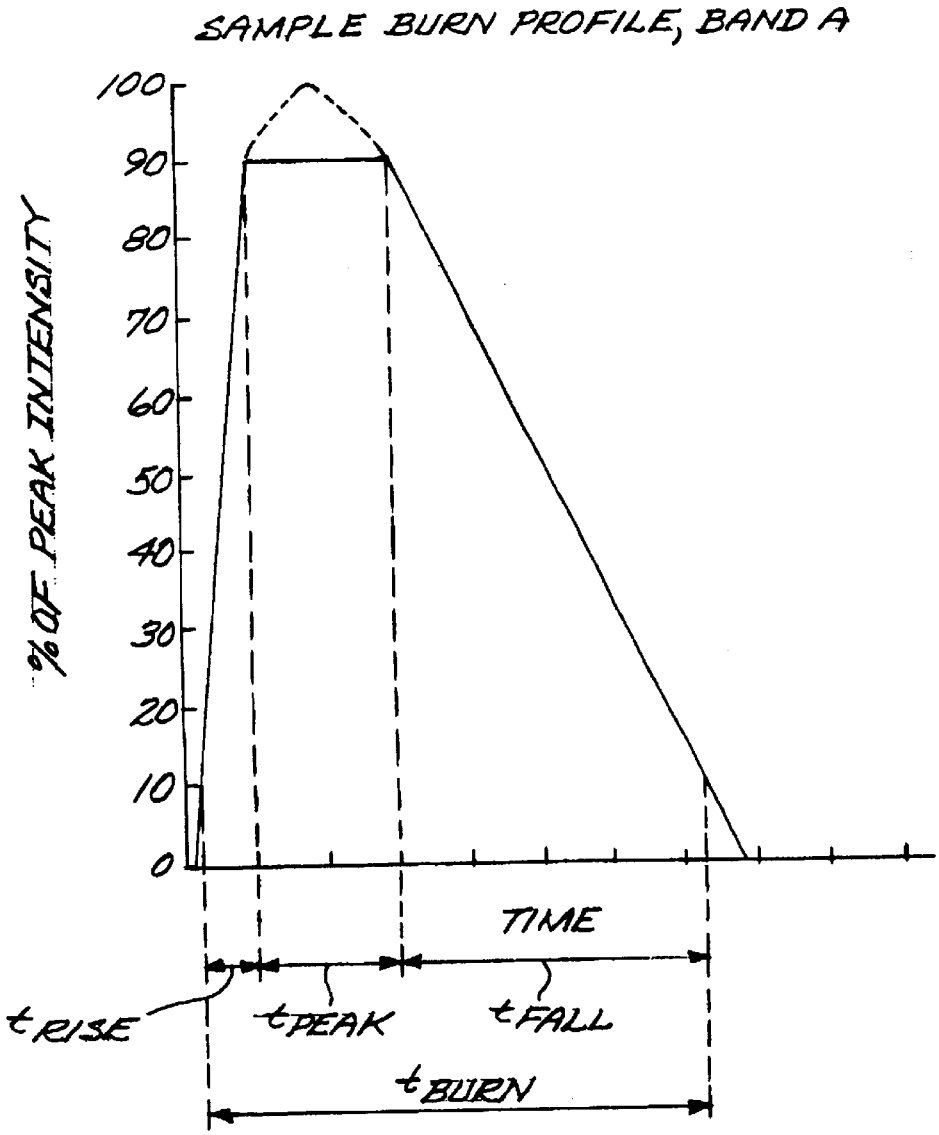
FIG. 6 is an idealized schematic diagram of the burn profile of an infrared source.

When the infrared-producing elements are dispensed from the infrared-source dispenser 24, the pyrophoric or other heat-producing action initiates, rises to a maximum output, and then falls. FIG. 6 schematically illustrates a burn profile for a preferred pyrophoric infrared source 28. The total burn time, $t_{burn}$, is the sum of the rise time from 10-percent-of-peak intensity to 90-percent-of-peak intensity, $t_{rise}$, the time at or above 90-percent-of-peak intensity, $t_{peak}$, and the time over which the pyrophoric burning falls from the 90-percent-of-peak intensity to 10-percent-of-peak intensity, $t_{fall}$. The 90 and 10 percent levels are used in the mathematical development to avoid the necessity to determine precisely the location of the maximum value and to avoid initiation and tailoff effects.

The properties of the infrared-producing elements may be calculated responsive to the nature of the threat, the nature of the aircraft, the geometry of the engagement, and other factors. The following is a presently preferred approach for designing the nature of the infrared-producing elements, but others are possible as well. In the present approach, the rise time $t_{rise}$ lies in a range such that the peak (defined as the period greater than 90-percent-of-peak intensity) in FIG. 6 occurs between a minimum distance $loc_{min}$ from the aircraft 20 and a maximum distance $loc_{max}$ from the aircraft. If the rise time is too short, the peak is reached when the infrared sources are too close to the aircraft, and the decoying of the threat 30 will be unsuccessful even if the threat is distracted away from the aircraft because the threat can detonate on the pattern 26 and still cause damage to the aircraft. If the rise time is too long, the sensor 36 of the threat 30 will not be distracted from the aircraft because the dispensed infrared source is too far away from the aircraft and outside the field of view of the sensor 36, assuming the worst case wherein the sensor 36 has already acquired the aircraft 20 prior to the initiation of the decoying procedure.

The minimum distance may be calculated relative to the center of the aircraft 20 measured along the direction of flight 22 as $$loc_{min}=loc_{disp}+L_{ac}/2+r_{lethal}$$

where $loc_{disp}$ is the location of the infrared-source dispenser 24 relative to the center of the aircraft (forward of center is a positive number, and aft of center is a negative number), $L_{ac}$ is the length of the aircraft 20 measured parallel to the direction of flight 22, and $r_{lethal}$ is the lethal radius of the threat 30 upon detonation (zero for a contact fuse).

The maximum distance is $$loc_{max}=loc_{disp}+L_{ac}/2+R\tan\alpha$$

where R is the nominal range of the launch envelope of the threat 30, its distance as illustrated in FIG. 3.

The distances may be converted to times by dividing by the respective minimum velocity $v_{min}$ and maximum velocity $v_{max}$ of the aircraft 20 during the period when it is potentially exposed to the threat 30, for example a ground-attack profile. The rise time $t_{rise}$ lies between these two times:

$$loc_{max}/v_{max}>t_{rise}>loc_{min}/V_{min}$$

The peak duration and temperature of each infrared-source element are determined based upon the aircraft minimum signature and avoiding the triggering of the counter-countermeasures of the threat 30. Here, $$J_{el,max,A}=C_{trig}\times J_{ac,min,A}$$

where $J_{el,max,A}$ is the maximum peak radiant intensity for an element in watts per steradian in infrared spectral band A, $C_{trig}$ is the ratio at which the missile of interest triggers its counter-countermeasures, and $J_{ac,min,A}$ is the minimum aircraft radiant intensity in watts per steradian in spectral band A.

To maximize the dispensing time and thence the effectiveness of the present decoying procedure, the chosen infrared-emitting material should not be precisely a spectrally correct match for the aircraft-signature plume 25. That is, each infrared source is not individually spectrally correct for the aircraft infrared-signature plume. Instead, the infrared sources 28 should burn hotter than is indicated to match the characteristics of the aircraft exhaust, because a number of infrared sources 28 are in the field of view of the sensor 36 at any moment, some of which are burning brightly and others of which are not at their peak outputs. The sensor perceives an average of these infrared-emitting sources 28. The use of the infrared-emitting sources that burn more brightly means that fewer sources are required for dispensing during a period of time, increasing the time over which dispensing may occur for a dispenser of fixed capacity.

The apparent intensity at any moment in time as perceived by the sensor 36 is $$J=\Sigma J_n/N$$

where J is the average radiant intensity in the field of view of the sensor 36, $J_n$ is the radiant intensity of each of the infrared source elements, N is the total number of infrared source elements in the field of view of the sensor 36, and the sum is over all of the N elements. If more than one type of infrared source 28 is dispensed, the sum is over all of the types of dispensed infrared sources that are in the field of view of the sensor 36 at a moment in time.

To determine the average temperature, the sum is performed over multiple infrared spectral bands. The average temperature is lower than the peak temperature of the material. To determine the optimum temperature of the material, the performance in a second spectral band, here indicated as band B, so that $$J_{el,max,B}\beta\times J_{match,B}$$

where $J_{el,max,B}$ is the maximum peak radiant intensity for each infrared source element in watts per steradian in band B, β is an optimization factor that is the ratio of the energy in two different spectral bands, and $J_{match,B}$ is the spectral matched intensity in watts per steradian of the sensor 36 in band B to perfectly match the sensor requirements. The value of β may be increased or decreased based upon the granularity of the infrared-source element. The more controllability in the minimum element size, the larger β may be. For example, for a single point flare, β=1, and the material is spectrally matched. For ideal infrared-source elements that may be spread out evenly over the rise time, the value of β may be as great as 2.0. Using the ratio of $J_{el,max,A}$ to $J_{el,max,B}$, the temperature of the material is determined.

The peak burn time of the infrared-source element is $$t_{peak}=t_{rise}=\beta$$

The minimum burn duration $t_{burn}$ of each infrared-source element is determined as $$t_{burn}=R_{beam}(\tan\alpha)/v_{ac}$$

where $R_{beam}$ is the maximum launch range of the threat 30 for a θ value of 90 degrees (the "beam" orientation), and $v_{ac}$ is an average velocity of the aircraft.

From this development, the values of $t_{burn}$, $t_{rise}$, and $t_{peak}$, as well as the maximum temperature of the infrared-source element at its peak in FIG. 6, are determined within limits as indicated for use in step 50. That is, the set of infrared-emitting properties of the infrared sources is selected responsive to the set of infrared detecting characteristics of the infrared sensor (e.g., the value of α and $C_{trig}$), a set of operating characteristics of the missile (e.g., its range envelope), and a set of operating characteristics of the aircraft (e.g., its velocities).

Once these properties of the infrared-source elements are established, the modulated pattern of step 52 is determined. The modulated pattern typically includes a plurality of groups of infrared sources, with each group divided into subpatterns.

In a preferred approach, in each group there is an initial peak burst of infrared energy output, termed the "initial-distraction subpattern", to provide a more attractive target for the sensor 36 than is the aircraft 20, so that the sensor is initially drawn to the dispensed infrared sources and away from the aircraft 20. The number of infrared-source 28, $N_{peak}$, dispensed in the initial-distraction subpattern that is required to achieve the minimum jamming-to-signal ratio ($J/S_{min}$) is determined based on the worst case-aircraft signature. If missile warning is available, this selection may be tailored based on the known aspect angle of the geometric engagement scenario. The value of $N_{peak}$ is computed as $$N_{peak}=(J/S_{min})\times(J_{target})/J_{el,max,A}$$

where $J_{target}$ is the peak radiant intensity of the aircraft and $J_{el,max,A}$ is the peak radiant intensity of each infrared-source element in band A.

The initial-distraction subpattern provides a burst of energy within the field of view of the sensor that is more attractive to the sensor than is the aircraft signature, and therefore causes the sensor intelligence to analyze the initial-distraction as a potential target. However, absent some further feature of the modulated pattern, the further analysis of the infrared-source pattern by the sensor intelligence may cause it to determine that the infrared-source pattern is a decoy, and to seek to re-acquire the previously-acquired target, a process termed a "counter-countermeasure". For example, the sensor intelligence may include a forward biasing that causes it to extrapolate the earlier-determined path of the initially-acquired target and seek to re-acquire the target aircraft 20 at that extrapolated position.

Each group of dispensed infrared sources 28 therefore further includes an "attention-holding subpattern" selected responsive to the geometry of the engagement and/or to the characteristics of the infrared sensor and/or the characteristics of the aircraft such as its velocity, which seeks to retain the acquisition of the sensor on the infrared sources by convincing the sensor intelligence that the dispensed pattern is the actual target of interest. The determination and utilization of the attention-holding subpattern evidences one of the important advantages of using a large number of discrete infrared sources such as pyrophoric foils, rather than a smaller number of conventional flares.

Figure 7:
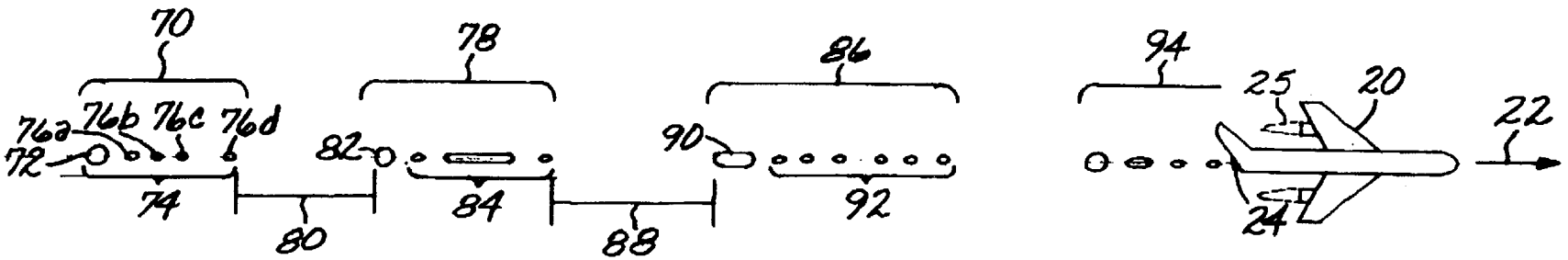
FIG. 7 is a schematic illustration of a modulation pattern.

Each sequential group of dispensed infrared sources may, in general, have a different attention-holding subpattern. FIG. 7 illustrates the approach with a schematic example. In a first group 70 of dispensed infrared sources, an initial-distraction subpattern 72 in the form of a single large burst is followed by an attention-holding subpattern 74. The attention-holding subpattern 74 is illustrated as three short bursts 76*a*, 76*b*, and 76*c*, followed after a slight delay by a fourth short burst 76*d*. Each of the bursts 72, 76*a*, 76*b*, 76*c*, and 76*d* is formed by dispensing infrared sources from the infrared-source dispenser 24, but in different numbers. A larger burst is produced by the rapid dispensing of a larger number of infrared sources. The intensity and spectral contents of the bursts is further determined by the nature of the dispensed material, determined in the manner discussed earlier.

A second group 78 follows the first group 70 by a temporal and spatial gap 80. The second group 78 includes an initial-distraction subpattern 82, which in this case is the same as the initial-distraction subpattern 72 of the first group 70, followed by an attention-holding subpattern 84 that is different from the attention-holding subpattern 74 of the first group.

A third group 86 follows the second group 78 by a temporal and spatial gap 88. The third group 86 includes an initial-distraction subpattern 90, which in this case is different from the initial-distraction subpattern 72 and 82, followed by an attention-holding subpattern 92 that is different from the attention-holding subpattern 74 and 84.

A fourth group 94 is just being dispensed by the aircraft 20.

In each of the groups 70, 78, 86, and 94, there are at least two of the bursts and preferably at least three of the bursts. The bursts are separated from each other in time and space. In the preferred approach, the first burst defines the initial-distraction subpattern, and the subsequent bursts define the attention-holding subpattern. The use of two or more bursts in the attention-holding subpattern permits the attention-holding subpattern to be tailored for the characteristics of the sensor 36. Each burst includes a number of the individual infrared sources 28, with the intensity of each burst being dependent upon the number of infrared sources 28 within the burst. There is a gap, such as the gaps 80 and 88, between the groups. The gaps prevent re-acquisition of the aircraft 20 by the sensor 36, by providing a spatial and temporal separation between the group and the aircraft.

The groups 70, 78, 86, and 94 are patterned differently in order to present the greatest potential for initial distraction and attention holding for various types of sensors and various geometric engagement scenarios. For example, in a worst case where both the sensor type is not known with certainty but can be only sensor type A and sensor type B, and the geometry of the engagement is unknown, the first group 70 may be patterned to present the greatest chance of response and decoying against sensor type A at an aspect angle θ of 0–45 degrees; the second group 78 may be patterned to present the greatest chance of response and decoying against sensor type A at an aspect angle θ of 45–90 degrees; the third group 86 may be patterned to present the greatest chance of response and decoying against sensor type B at an aspect angle θ of 0–45 degrees; and the fourth group 94 may be patterned to present the greatest chance of response and decoying against sensor type B at an aspect angle θ of 45–90 degrees. Subsequent but unillustrated groups may continue this type of sequence by presenting patterns directed toward sensor type A at the remaining possible aspect angles, and patterns directed toward sensor B at the remaining possible aspect angles. In some cases modulation scenarios may be combined, because, for example, the same group pattern that is attractive to sensor type A in a particular engagement geometry may also be attractive to sensor type B in that same engagement geometry, and accordingly duplication is not necessary. These modulation patterns are determined from the known characteristics of each sensor type and the geometric engagement information such as that presented in FIGS. 3–4.

The dispensed pattern may be continued in this manner, and may be repeated after all of the scenarios of sensor type and geometry have been dispensed. It is necessary only that at least one infrared source group be presented to the infrared sensor that is more attractive to the sensor than is the aircraft being protected, to initially distract and hold the attention of the missile, causing it to lose acquisition of the aircraft. Thus, if a typical time of flight of a threat missile is 3–15 seconds and a typical duration of each dispensed group is about 0.6 seconds, at least about 5 groups of infrared sources 28 may be dispensed during the minimum 3-second time of flight. Because of this large number of dispensed groups, a wide range of modulation strategies may be used to respond not only to the sensor type and the geometry of the engagement scenario, but also to other factors such as different counter-countermeasure strategies that missiles may employ. A longer time of flight than the minimum increases the likelihood of decoying the threat, inasmuch as additional groups are dispensed.

Another feature of the present approach is that the modulation of the dispensing may be altered depending upon many factors, such as where the aircraft learns of its attacker and gains additional information about its attacker during the course of an attack event. For example, if the aircraft were to gain additional information such as a visual or instrument observation that the aspect angle θ of the attack was in the 135–180 degree range (a common scenario in the form of an attack from the rear), but the nature of the missile was still unknown, then the modulation of the dispensing of the infrared sources from the dispenser 24 may be immediately changed so that all subsequent dispensed groups (during the current attack) would be directed against sensor type A or sensor type B, at an aspect angle θ of 135–180 degrees. If even further information were gained, as for example that the missile were identified as one using sensor type A and that the aspect angle θ was exactly 160 degrees, the modulation may be further fine-tuned so that subsequent groups were solely directed against sensor type A with an aspect angle of 160 degrees, until such time as the missile were decoyed away. These fine-tuning steps are presented by way of illustration and not practicality, as in most cases the fine tuning of the modulation would leave some variability of the modulation of the dispensed pattern of infrared sources to account for the possibility that another simultaneous attack by an unknown missile was underway, that the identification of the first missile was in error, that the aircraft itself maneuvers so that the aspect angle changes, and the like. The development of optimal strategies is dependent upon the identification of specific missile and engagement scenarios, as well as the identification of the aircraft to be protected.

The present approach also selects the infrared source material and the dispensing pattern to conserve on the use of the infrared source material as much as possible. With conventional flares, the usual practice is to dispense the flares only after the aircraft crew becomes aware that an attack is underway, which awareness may not occur at all so that the aircraft is unprotected. With the present approach, it is expected that an aircraft may carry a sufficient quantity of the infrared sources that they may be dispensed in the modulation patterns for extended periods of time, as for example several minutes and thus during the entire exposure period when the aircraft is at most risk. For example, a ground-attack aircraft that is at most risk when it is making a ground-attack run may begin the modulated dispensing as it begins the ground-attack run and continue the modulated dispensing until the completion of the ground-attack run, before it returns to a safe altitude and leaves the area where it is most vulnerable.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to a set of infrared detecting characteristics of the infrared sensor, wherein the set of infrared-emitting properties includes at least one of a rise time, a time-at-peak, and a burn duration of the infrared sources; and dispensing a modulated pattern of the infrared sources from the infrared-source dispenser.

2. The method of claim 1, wherein the threat is a missile, and wherein the step of providing further includes a step of selecting the set of infrared-emitting properties responsive to a set of operating characteristics of the missile.

3. The method of claim 1, wherein the step of providing includes the step of selecting the set of infrared-emitting properties responsive to a set of operating characteristics of the aircraft.

4. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to an infrared field of view of the infrared sensor; and dispensing a modulated pattern of the infrared sources from the infrared-source dispenser.

5. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to a counter-countermeasure triggering level of the infrared sensor; and dispensing a modulated pattern of the infrared sources from the infrared-source dispenser.

6. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to a set of infrared detecting characteristics of the infrared sensor, and wherein the step of providing includes the step of providing two dispensers, wherein a first dispenser dispenses a first infrared source having a first set of infrared-emitting properties, and the second dispenser dispenses a second infrared source having a second set of infrared-emitting properties; and dispensing a modulated pattern of the infrared sources from the infrared-source dispenser.

7. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to a set of infrared detecting characteristics of the infrared sensor; and dispensing a modulated pattern of the infrared sources from the infrared-source dispenser, wherein the aircraft has an aircraft infrared-signature plume, and wherein each infrared source is not individually spectrally correct for the aircraft infrared-signature plume.

8. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to a set of operating characteristics of the aircraft; and dispensing a modulated pattern of the infrared sources from the infrared-source dispenser, wherein the modulated pattern is determined responsive to a geometric engagement scenario of the aircraft and the threat.

9. The method of claim 8, wherein the step of providing includes the step of selecting the set of infrared-emitting properties of the infrared sources responsive to a set of infrared detecting characteristics of the infrared sensor.

10. The method of claim 8, wherein the threat is a missile, and wherein the step of providing includes a step of selecting the set of infrared-emitting properties responsive to a set of operating characteristics of the missile.

11. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to an infrared field of view of the infrared sensor; and dispensing a modulated pattern of the infrared sources from the infrared-source dispenser, wherein the modulated pattern is determined responsive to a geometric engagement scenario of the aircraft and the threat.

12. A method for protecting an aircraft having an aircraft motion against a threat that utilizes an infrared sensor, comprising the steps of providing a plurality of dispensable infrared sources transported in an infrared-source dispenser with the aircraft, wherein a set of infrared-emitting properties of the infrared sources is selected responsive to a counter-countermeasure triggering level of the infrared sensor; and dispensing a modulated pattern of the infrared sources from the infrared-source dispenser, wherein the modulated pattern is determined responsive to a geometric engagement scenario of the aircraft and the threat.

13. A method for protecting an aircraft having an aircraft motion against a threat that utilizes an infrared sensor, comprising the steps of providing a plurality of dispensable infrared sources transported in an infrared-source dispenser with the aircraft; and dispensing a modulated pattern of the infrared sources from the infrared-source dispenser, wherein the modulated pattern is determined responsive to a geometric engagement scenario of the aircraft and the threat, and wherein the step of dispensing includes the additional step of dispensing the modulated pattern responsive to a set of infrared detecting characteristics of the infrared sensor.

14. A method for protecting an aircraft having an aircraft motion against a threat that utilizes an infrared sensor, comprising the steps of providing a plurality of dispensable infrared sources transported in an infrared-source dispenser with the aircraft; and dispensing a modulated pattern of the infrared sources from the infrared-source dispenser, wherein the modulated pattern is determined responsive to a geometric engagement scenario of the aircraft and the threat, and wherein the step of dispensing the modulated pattern includes the substep of dispensing a kinematic subpattern kinetically approximating the aircraft motion for a first geometric engagement scenario.

15. The method of claim 14, including an additional step, after the step of dispensing the kinematic subpattern, of dispensing a second kinematic subpattern kinetically approximating the aircraft motion for a second geometric engagement scenario, with a gap between the kinematic subpattern and the second kinematic subpattern.

16. A method for protecting an aircraft having an aircraft motion against a threat that utilizes an infrared sensor, comprising the steps of providing a plurality of dispensable infrared sources transported in an infrared-source dispenser with the aircraft; and dispensing a modulated pattern of the infrared sources from the infrared-source dispenser, wherein the modulated pattern is determined responsive to a geometric engagement scenario of the aircraft and the threat, and wherein the step of dispensing the modulated pattern includes the substeps of dispensing a first initial-distraction subpattern, and thereafter dispensing a first attention-holding subpattern different from the first initial-distraction subpattern.

17. The method of claim 16, wherein the step of dispensing the modulated pattern includes the substeps of dispensing a second initial-distraction subpattern, and thereafter dispensing a second attention-holding subpattern different from the second initial-distraction subpattern and different from the first attention-holding subpattern.

18. A method for protecting an aircraft having an aircraft motion against a threat that utilizes an infrared sensor, comprising the steps of providing a plurality of dispensable infrared sources transported in an infrared-source dispenser with the aircraft; and dispensing a modulated pattern of the infrared sources from the infrared-source dispenser, wherein the modulated pattern is determined responsive to a geometric engagement scenario of the aircraft and the threat, and wherein the step of dispensing the modulated pattern includes the substeps of dispensing an initial-distraction subpattern having an infrared characteristic selected responsive to a set of infrared detecting characteristics of the infrared sensor, and dispensing a kinematic subpattern kinetically approximating the aircraft motion.

19. A method for protecting an aircraft having an aircraft motion against a threat that utilizes an infrared sensor, comprising the steps of providing a plurality of dispensable infrared sources transported in an infrared-source dispenser with the aircraft; and dispensing a modulated pattern of the infrared sources from the infrared-source dispenser, wherein the modulated pattern is determined responsive to a geometric engagement scenario of the aircraft and the threat, and wherein the step of dispensing the modulated pattern includes the substeps of dispensing an initial-distraction subpattern having an infrared characteristic selected responsive to a set of infrared detecting characteristics of the infrared sensor and more attractive to the infrared sensor than the aircraft, and dispensing a kinematic subpattern kinetically approximating the aircraft motion.

20. A method for protecting an aircraft having an aircraft motion against a threat that utilizes an infrared sensor, comprising the steps of providing a plurality of dispensable infrared sources transported in an infrared-source dispenser with the aircraft, and dispensing a modulated pattern of the infrared sources from the infrared-source dispenser, the step of dispensing a modulated pattern including the steps of dispensing a first initial-distraction subpattern, and thereafter dispensing a first attention-holding subpattern different from the first initial-distraction subpattern.

21. The method of claim 20, wherein the first initial-distraction subpattern comprises a first initial-distraction subpattern burst of at least two of the infrared sources, and wherein the first attention-holding subpattern comprises a first attention-holding subpattern burst of at least two of the infrared sources.

22. The method of claim 20, wherein the first initial-distraction subpattern comprises a first initial-distraction subpattern burst of at least two of the infrared sources, and wherein the first attention-holding subpattern comprises at least two first attention-holding subpattern bursts, each having at least two, of the infrared sources.

23. The method of claim 20, wherein the step of dispensing the modulated pattern includes the additional substeps of dispensing a second initial-distraction subpattern, and thereafter dispensing a second attention-holding subpattern different from the second initial-distraction subpattern and different from the first attention-holding subpattern.

24. The method of claim 20, wherein the step of dispensing includes the step of varying the modulated pattern responsive to information gained during the course of an attack on the aircraft.

25. The method of claim 20, wherein the threat is a missile, and wherein the step of providing includes the step of selecting a set of infrared-emitting properties of the infrared sources responsive to a set of operating characteristics of the missile.

26. The method of claim 20, wherein the step of providing includes the step of selecting a set of infrared-emitting properties of the infrared sources responsive to a set of operating characteristics of the aircraft.

27. The method of claim 20, wherein the step of providing includes the step of selecting a set of infrared-emitting properties of the infrared sources responsive to a set of infrared detecting characteristics of the infrared sensor.

* * * * *